US007793905B2

(12) United States Patent
Merritt et al.

(10) Patent No.: US 7,793,905 B2
(45) Date of Patent: Sep. 14, 2010

(54) TRAVELING LAPTOP BEVERAGE CONTAINER HOLDER

(76) Inventors: William Harold Merritt, 8856 Etera Dr., Sarasota, FL (US) 34238; Jeffrey A. Taylor, 2200 Arch St., Philadelphia, PA (US) 19103

( * ) Notice: Subject to any disclaimer, the term of this patent is extended or adjusted under 35 U.S.C. 154(b) by 274 days.

(21) Appl. No.: 11/776,337

(22) Filed: Jul. 11, 2007

(65) Prior Publication Data

US 2009/0014622 A1 Jan. 15, 2009

(51) Int. Cl.
*A47K 1/08* (2006.01)
*A47G 1/10* (2006.01)

(52) U.S. Cl. ..... 248/315; 248/311.2; 248/314; 248/316.1

(58) Field of Classification Search ..... 248/311.2, 248/312.1, 313, 315, 316.1, 309.1, 314, 689, 248/231.71, 229.1, 229.13, 229.2; 224/926
See application file for complete search history.

(56) References Cited

U.S. PATENT DOCUMENTS 3,991,961 A * 11/1976 Platzer, Jr. ..... 248/99
4,256,281 A 3/1981 Harris et al.
5,007,612 A * 4/1991 Manfre ..... 248/558
5,074,506 A * 12/1991 Larsen ..... 248/309.1
5,102,086 A 4/1992 Thomason
5,190,257 A * 3/1993 Gradei et al. ..... 248/231.71
5,220,744 A * 6/1993 Kendall ..... 248/311.2
5,356,107 A 10/1994 Sinohuiz
5,425,497 A 6/1995 Sorensen
5,450,690 A * 9/1995 Elsea ..... 47/41.01
5,456,046 A * 10/1995 Vitalune et al. ..... 248/214
5,639,052 A * 6/1997 Sauve ..... 248/311.2
5,853,158 A 12/1998 Riggle
5,996,957 A 12/1999 Kurtz
6,092,776 A 7/2000 You
6,390,427 B1 5/2002 McConnell et al.
6,505,802 B2 1/2003 Fowler
6,550,737 B1 4/2003 Sai et al.
6,832,745 B2 12/2004 Lindsay
2009/0121107 A1 * 5/2009 Lagobi ..... 248/311.2

* cited by examiner

*Primary Examiner*—J. Allen Shriver
*Assistant Examiner*—Tan Le
(74) *Attorney, Agent, or Firm*—Duane Morris LLP

(57) ABSTRACT

The presently claimed invention discloses a portable beverage container holder that can be used by an end user during travel to hold beverages and other types of items. The portable beverage container can be used in conjunction with a laptop computer or other type of planar surface and can be folded up when not in use to minimize its size during storage. The device also includes a means for clamping to a laptop computer and other planar surface that minimizes damage to the laptop computer and enables an end user to quickly clamp and unclamp the device during transit.

33 Claims, 12 Drawing Sheets

TRAVELING LAPTOP BEVERAGE CONTAINER HOLDER

FIELD OF THE INVENTION

The present invention generally relates to the field of beverage container holders, and more particularly pertains to a traveling beverage container holder adapted for mounting to a laptop computer.

BACKGROUND OF THE INVENTION

With the increased availability and decreased cost of various transportation modalities, traveling has become commonplace. Whether commuting between home and office, partaking in business trips, or traveling abroad or domestically, consumers spend a significant amount of time in transit. Often, a businessperson may travel to multiple cities in the course of conducting transactions or visiting clients. Some business travelers routinely shuttle back and forth between various corporate offices, while still other business travelers spend a large percentage of time in transit in an effort to generate sales. To put the need to travel in perspective, it is estimated a person spends on average approximately 1.3 hours traveling a day, with the average distance traveled equaling approximately 7,400 miles per year. Most current research estimates project the amount of time a person spends in transit to increase in upcoming years. Because a significant portion of a person's day is devoted to traveling, there is growing need for accessories and accoutrements that enable a traveler to take advantage of time spent in transit.

Perhaps no other tool has become as indispensable to the traveler as the laptop computer and other such portable computing devices. With wireless broadband internet access now available at a great variety of non-traditional locales such as parks, coffee shops and transportation terminals, the use of laptop computers and other portable computing devices is fast becoming the norm. With the advent of wireless communication protocol and the increased proliferation of laptop computers and other portable computing devices, time that was normally wasted during transit can now be utilized to conduct business transactions, to perform research, or to draft documents. No longer are individuals limited to using computers solely in the confines of the office or the home, as portable computing devices enable individuals to access and utilize the world wide internet from virtually anywhere and at any time, even when traveling.

Regardless of the reason for travel, businesspeople have common needs: the need to maintain contact with the office and the need to utilize travel time to continue. Because laptop computers are portable, end users often utilize laptop computers during travel, whether such travel is by car, train, or airplane. This trend is reflected in the growing number of railroad cars, airlines, and buses that provide travelers with access to power outlets and wi-fi hotspots. When deploying laptop computers and other computing devices during transit, most travelers attempt to re-create a compact and portable office environment that mimics a full-sized office environment. While in transit, travelers have a need to reference papers and notes and have a need to use pens, pencils and other such office accessories, but are often constricted by the amount of space available to place these items. Likewise, travelers frequently consume beverages while traveling and are limited by the amount of space available to place beverages, especially when laptop computers and other portable computing devices occupy the majority of available space.

The small surface areas provided by the fold-down table trays found on most airplanes, buses, and trains often leave little to no extra space for resting and/or securing beverage containers or other office accessories. Often, there might not even be a fold down tray table or other such surface available to the traveler, giving the traveler even less space to work.

Because of the minimal amount of workspace available in transit, it is not uncommon for travelers to spill beverages or lose various accompanying items. For example, many commuters drink coffee in the morning and throughout the day. While on a train, drinking coffee and working on a laptop computer simultaneously can be a difficult if not impossible task, especially when the amount of workspace available is at a minimum. Moreover, the stop-and-go motion of the train greatly increases the risk of damage to a traveler's laptop computer via spills and errant splashes from the adjacent beverage container. Likewise, documents, pens, pencils, and other office supplies are often displaced from the limited workspace available during transit. Documents fall beneath seats, and pens and pencils become wedged between cushions or seat rows, all of which disrupt a traveler's workflow and efficiency. Consequently, it is apparent there is a growing need for a simple and effective means for increasing the amount of workspace available to a traveler, so as to prevent accidental and damaging spills from beverage containers and to be able to place documents, pens, pencils and other accessories in a secure area. The presently contemplated invention described herein addresses the need for creating additional workspace during travel by proposing a portable beverage container used in conjunction with a laptop computer and other such portable computing devices, with said beverage container holder being used to hold beverages or other types of office supplies, items and accessories.

There are a variety of prior art patents disclosing the use of portable beverage container holders in conjunction with objects other than computers. U.S. Pat. No. 6,832,745 B2 to Lindsay, for example, discloses a vehicle accessory holder adapted for use in a motor vehicle having vertical support posts in the passenger compartment of the vehicle. While the invention contemplated in Lindsay describes a means of providing a detachable container holder, the invention nonetheless is limited to automobiles and further limited to automobiles having a particular vertical support post in the passenger compartment. The invention described in Lindsay does not work in buses, airplanes, trains, or in automobiles lacking the vertical support post. Consequently, the invention described in Lindsay fails to address the need for a portable container that can be used in every travel scenario or the need for a portable container that can be used in conjunction with a laptop computer or other such portable computing device.

U.S. Pat. No. 5,356,107 to Sinohuiz also discloses a beverage container holder. Specifically, the beverage container holder described in Sinohuiz is capable of being removably attached to a substantially vertical chair member, with the beverage container being rigid and not collapsible. The invention described in Sinohuiz is primarily geared towards lawn chairs, with the beverage container specifically configured to snap onto the arm of a typical lawn chair. The beverage container holder disclosed in Sinohuiz is not capable, however, of attaching to a surface other than the arm of a typical lawn chair, nor is the Sinohuiz beverage container holder easy to transport since it is rigid and not collapsible. Thus, the invention disclosed by Sinohuiz fails to address the prior art problem of a portable beverage container holder that can be used in any transportation modality and in conjunction with a laptop computer or other such portable computing device.

The same limitations described in Sinohuiz also apply to U.S. Pat. No. 6,505,802 B2, issued to Fowler. The beverage holder described in Fowler is permanently attached to a mounting surface via a threaded bolt and a threaded nut, and cannot easily be removably attached, transported or reattached to other surfaces. Consequently, the beverage container holder disclosed in Fowler, just like the previously described patents, fails to address the need for a portable beverage container holder that can easily attach itself to a laptop computer regardless of the travel environment.

There are a slew of prior art patents that contemplate the use of cup holders in conjunction with other types of surface environments. For example, there are various beverage container holders found in the art that secure to a horizontally disposed support structure, such as the handlebar of a bicycle, including U.S. Pat. No. 4,256,281 to Harris, and U.S. Pat. No. 6,390,427 B1 to McConnell. The inventions described in Harris and in McConnel are limited, however, in that they are not portable, require multiple steps to install the beverage container holder, and can not be used in settings that lack a horizontal support structure. As a whole, prior art portable beverage container holders fail to address the traveler's specific need for an easy to store means for increasing workspace and holding beverages during transit.

Attempts to utilize beverage container holders in conjunction with desktop computers have been addressed in the prior art, specifically in U.S. Pat. No. 6,550,737 B1 to Sai, et. al. The Sai patent discloses a beverage container holder that secures to the side of a stationary desktop computer monitor via a vertically disposed clamp. The beverage container holder in Sai can be affixed to either the right or left vertical side of a desktop computer monitor. The beverage container holder claimed in Sai, however, is limited to desktop computer monitors and does not disclose use of the beverage container holder with a laptop computer or other such portable computing device. Moreover, the invention disclosed in Sai is not configured to attach to a laptop computer or to the monitors of a laptop computer, and consequently are not compatible with laptop computers and would not be useful during travel.

In reviewing the breadth of prior art there is a common and reoccurring problem, namely that prior art devices are rigid, bulky, and not specifically adapted to the current needs of laptop computer users. There is a clear need for a beverage container holder that is portable, flexible, lightweight, and capable of supporting different shapes and sizes of beverage containers and other types of office items and accessories. Regarding laptop computer use in particular, there is a need for a convenient, travel-friendly beverage container holder that safely and easily connects to the laptop computer support surface or the laptop base itself (in cases where the laptop computer operator's lap is the support surface). The presently claimed invention solves the problems present in the prior art and addresses the currently unmet needs of laptop computer users while in transit.

SUMMARY OF THE INVENTION

In view of the foregoing disadvantages inherent in the prior art, the present invention provides an improved device for holding and receiving beverage containers during transit. The present invention essentially comprises a portable beverage container for a laptop computer, having a pocket adapted to hold and receive the beverage container, with at least one aperture disposed about a length of the pocket and the aperture providing access to an inner compartment of the pocket. The portable beverage container is comprised additionally of at least one ring assembly which is itself comprised of an upper ring assembly and a lower ring assembly, with the pocket fastened between the upper ring assembly and the lower ring assembly. The ring assembly and pocket are connected to a means for clamping which in turn can be used to clamp to a laptop computer or other planar surface. It is an object of this presently contemplated invention to provide a beverage container holder that is removable, can be installed to the surface of a laptop computer or any other such portable computing device and increase the amount of workspace available to an end user while in transit.

BRIEF DESCRIPTION OF THE DRAWINGS

These and other features and advantages of the present invention will be more fully disclosed in the following detailed description of the preferred embodiment of the invention, which is to be considered together with the accompanying drawings wherein.

DETAILED DESCRIPTION OF THE PREFERRED EMBODIMENTS

Figure 1:
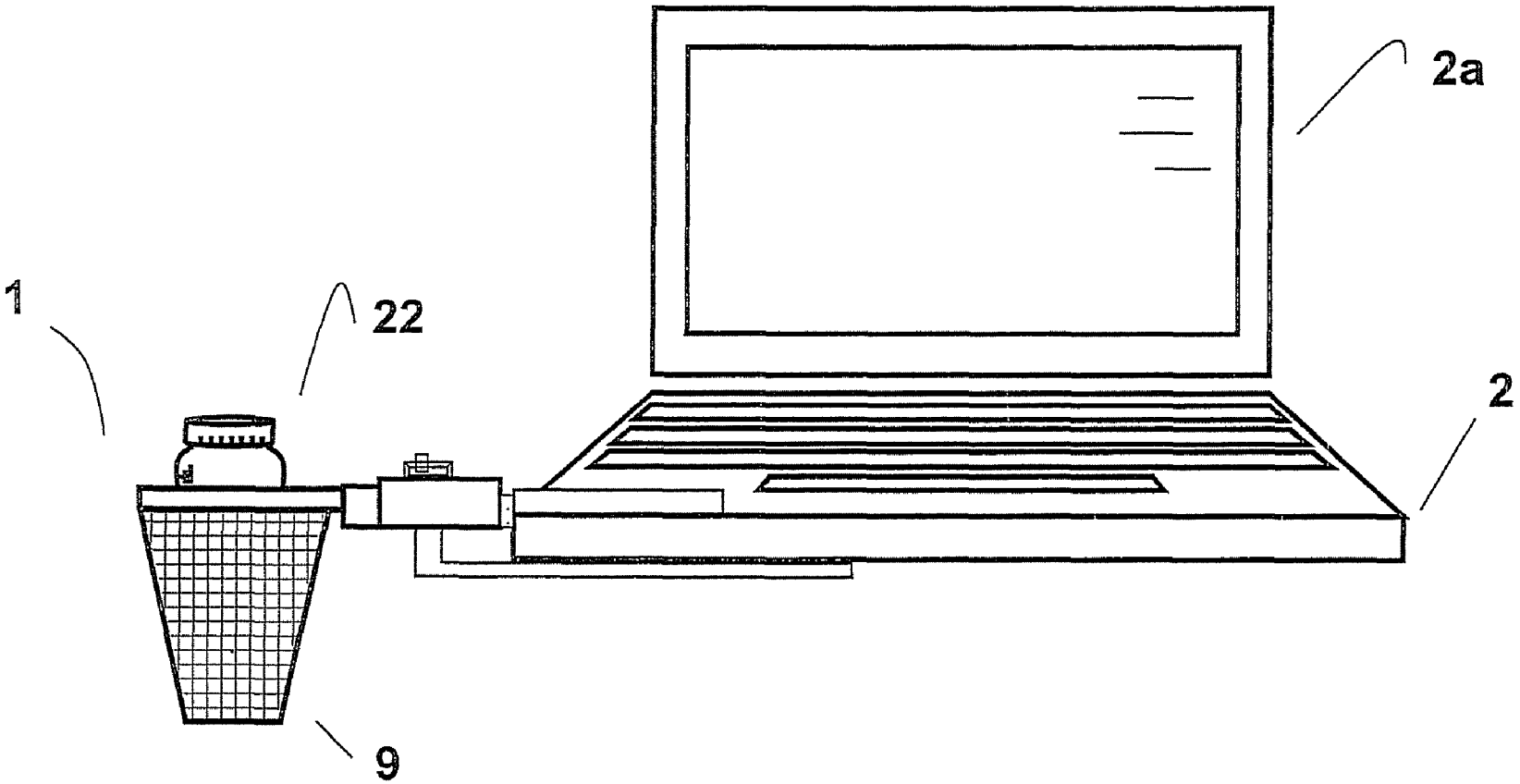
FIG. 1 is a front perspective view of the portable beverage container holder connected to an open laptop computer.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

The presently claimed invention envisions any one of numerous embodiments, all of which enable a user to utilize a beverage container holder that can be permanently and/or temporarily connected to a laptop computer or other such portable computing device. As an overview of the presently claimed invention, the reader is directed to FIG. 1. FIG. 1 depicts a beverage container holder 1 attached to a laptop computer 2 in the open position 2*a*, with bottle 22 inserted into and supported by pocket 9. While FIG. 1 presents the reader with a general overview of the presently claimed invention, the ensuing figures and drawings will examine the granular details of various embodiments of beverage container holder 1.

Figure 2:
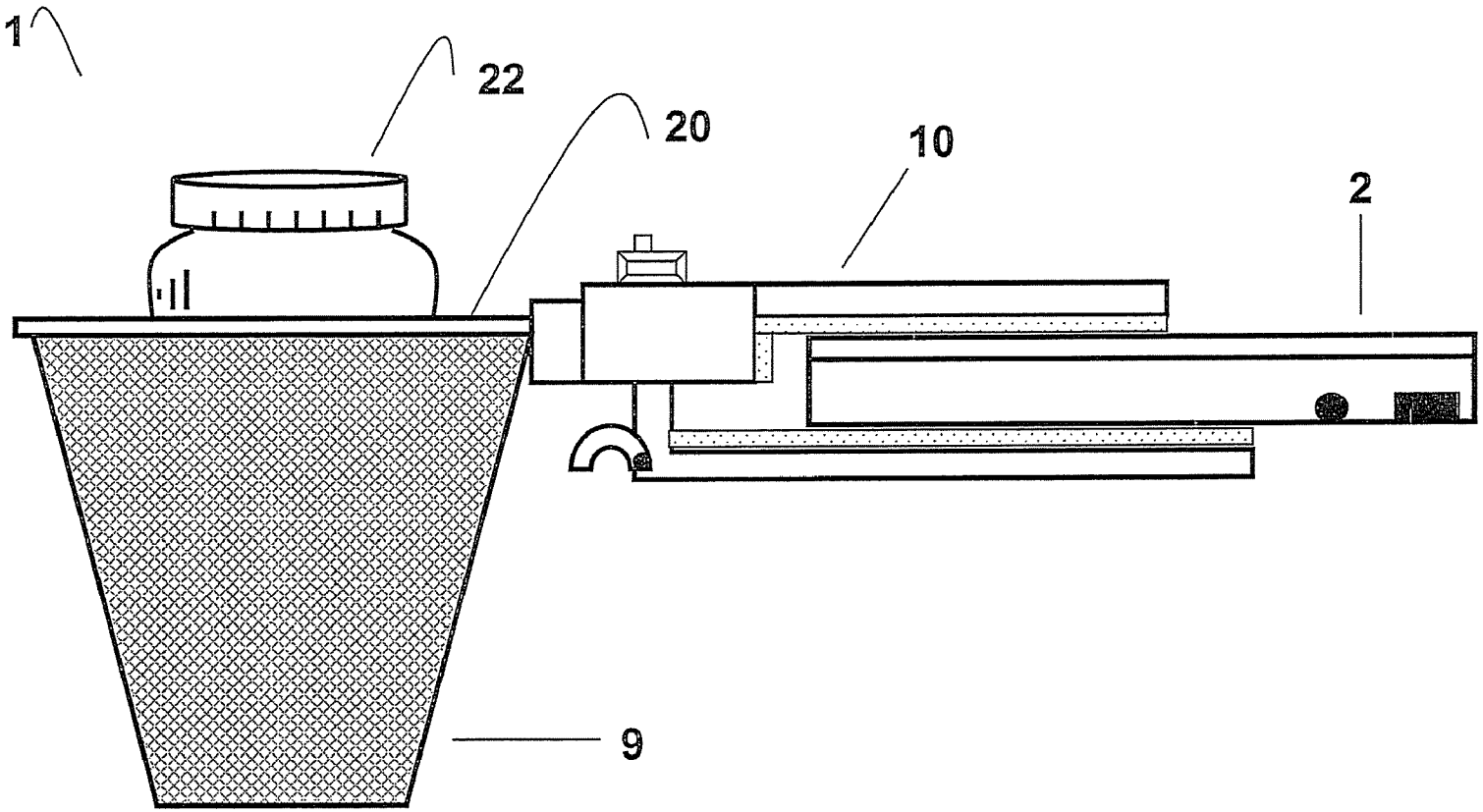
FIG. 2 is a front perspective overview of the portable beverage container holder connected to a cross section of a laptop computer.

Turning now to FIG. 2, presented is an more detailed example of how a given embodiment of the presently claimed invention operates in conjunction with a laptop computer. As contemplated in a typical embodiment of the presently claimed invention, beverage container holder 1 connects to laptop computer 2 or any other type of portable communication device via means for clamping 10, with bottle 22 being placed in pocket 9, pocket 9 being connected to means for clamping 10 via ring assembly 20. For purposes of this patent application, a "laptop computer" shall refer to a small mobile personal computer, usually weighing approximately one-quarter (¼) of a pound to five (5) pounds, depending on size, materials and other factors; laptop computers typically contain components that are substantially similar to desktop computers and perform many if not all of the same functions, but are miniaturized and optimized for mobile use and efficient power consumption. "Laptop computers" usually have monitors comprised of liquid crystal displays, plasma or other means utilized in the art for computer monitor displays. In addition to a built-in or attachable keyboard or other data input means, laptop computers may also utilize a touchpad or a pointing means for data input, although an external keyboard or mouse can usually be attached. As used in the art and herein, the term "laptop computer" also includes any number of other portable computing devices that enables a user to perform data manipulation, such as, but not limited to tablet PCs or any other type of portable computing devices found in the art.

Referring still to FIG. 2, the means for clamping 10 can be adapted or configured to connect to a laptop computer 2 of various shapes, sizes, widths, thicknesses and lengths. In the embodiment depicted in FIG. 2, for example, beverage container holder 1 connects via means for clamping 10 to a laptop computer 2 that has a thickness of ½ inch; but beverage container holder 1 can be adapted to connect to a laptop computer 2 with a thickness greater or less than ½ inch, encompassing any possible thickness and/or width presently utilized or produced in the future for laptop computers or other such portable computing devices. Beverage container holder 1 is advantageous to an end user, because when beverage container holder 1 is connected to a laptop computer 2 via clamping 10, a desired beverage can be placed and held in pocket 9, with pocket 9 connected to means for clamping 10 via ring assembly 20. Regardless of the setting in which the laptop computer 2 is deployed, beverage container holder 1 provides a means for holding and supporting an end user's beverage. In addition, although the drawings set forth herein depict beverage container holder 1 attached to a laptop computer, it is contemplated that the beverage container holder 1 can be attached to a multitude of additional surfaces, such as, without limitation, fold down table trays, seats, tables, desks, chairs, or any other planar surface.

In the particular embodiment depicted in FIG. 2, pocket 9 holds and supports bottle 22. For purposes of this invention, the composition and/or weight of bottle 22 is immaterial, as is the type of liquid contained in bottle 22. As contemplated herein, bottle 22 can have the form of a coffee container, carton, can, or any other type of container that holds liquid, and bottle 22 can be comprised of plastic, glass, or any other type of material that can hold liquid. In addition, pocket 9 can be used to support and hold any number of individual items or combination of items other than bottle 22. Such non-limiting examples of such items include: pens, pencils, markers, paper, post-it-notes, coins, transportation tickets, maps portable computing and communication devices and/or any other item that can fit within pocket 9.

The presently described invention depicts a pocket 9 that is comprised of mesh, but pocket 9 can be comprised of any type of suitable material, such as, without limitation: animal-based textiles, plant-based textiles, mineral-based textiles, synthetic-based textiles, or any other textile or material suitable for holding items. In addition, it is contemplated that pocket 9 can be comprised of metallic mesh or chain mail. Moreover, the present invention contemplates pocket 9 being lined with or comprised of materials having certain insulating properties so as to keep inserted items hot and/or cold, depending on an end user's preference. It is also envisioned that pocket 9 can be of a rigid nature, or that pocket 9 can be "collapsible," thereby allowing an end user to elongate or shorten the length of pocket 9 along the y-axis to accommodate differing shapes and lengths of various inserted items, bottles, or containers. In addition, although pocket 9 is depicted in FIG. 2 as having a similar shape as bottle 22, pocket 9 can be adapted to take any possible shape, such as, without limitation, a circular shape, an elliptical shape, a square shape, a trapezoidal shape, or any other polygonal shape necessary to hold an applicable item. It is contemplated that pocket 9 can be tapered from the top to bottom or bottom to top, and it is contemplated that pocket 9 can be fitted with a means of opening or closing the bottom of pocket 9 so as to remove inserted items from the bottom of pocket 9 instead of from the top of pocket 9. The top of pocket 9 can also be fitted with a means of opening or closing pocket 9 to remove inserted items. Pocket 9 may also have separate pocket compartments, disposed about the sides, top or bottom of pocket 9, so as to provide additional means of segregating change, tokens, pens, pencils and any other type of inserted item. Pocket 9 can also be fitted with an additional support structure at any point along pocket 9, such as without limitation, an additional cylindrical support structure disposed about the bottom of pocket 9. For purposes of this presently claimed invention, however, regardless what an end user places in pocket 9, the composition of pocket 9, or the configuration of pocket 9, beverage container holder 1 allows an end user to place a beverage or other such item in pocket 9, thereby obviating the need for an end user to hold a beverage or an item in his/her hand. By freeing up both of an end user's hands, an end user can type with both hands, thereby more efficiently interacting with the laptop computer 2.

Figure 3:
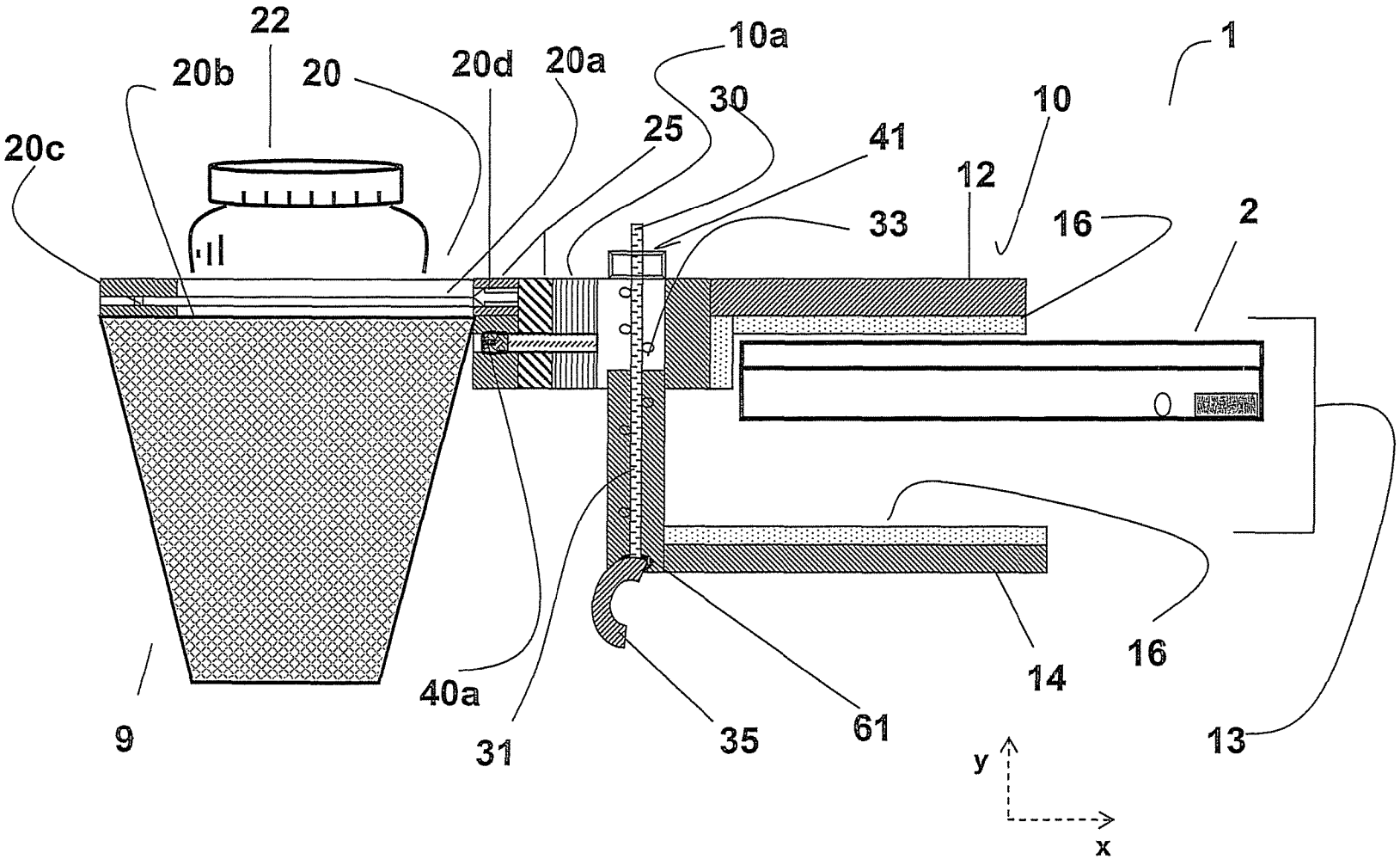
FIG. 3 is a side perspective view of the various components of an embodiment of the portable beverage container holder.

Now that a brief overview of beverage container holder 1 has been described, a more thorough explanation of each of the component parts of various contemplated embodiments will follow. Referring now to FIG. 3, beverage container holder 1 is typically comprised of at least two main sections, the means for clamping 10 and ring assembly 20. Means for clamping 10 and the ring assembly 20 can either be permanently connected or temporarily connected via junction point 25. In the particular embodiment depicted in FIG. 3, ring assembly 20 is connected to junction point 25 via snap point 20*d*, with snap point 20*d* permanently connected to junction point 25. Snap point 20*d* can either permanently or removably connect ring assembly 20 to junction point 25. In the particular embodiment depicted in FIG. 3, snap point 20*d* is connected to ring assembly 20 via a screw, but can be attached via any known connecting means used in the art.

Junction point 25 connects to means for clamping 10, with such connection being either permanent or detachable. In the particular embodiment depicted in FIG. 3, junction point 25 is connected to means for clamping 10 via an appropriately configured mechanical screw 40*a* disposed through an aperture running horizontally through the x-axis of junction point 25 and through the x-axis of means for clamping junction point 10*a*, with means for clamping junction point 10*a* being permanently attached to and a part of means for clamping 10; but any other means used to connect such structures known in the art can be utilized, such as, without limitation: hitch pins, cotter pins, springs, and welding.

For purposes of this invention, means for clamping 10, junction point 25 and ring assembly 20 can be comprised of any material that is known in the art. Polymeric materials useful for all or some of the components of the means for clamping 10, junction point 25 and ring assembly 20 include, without limitation: plastics, thermoplastics (crystalline or non-crystalline, cross linked or non-cross linked), thermosetting resins, elastomers, or composites thereof. Means for clamping 10, junction point 25 and ring assembly 20 can also be comprised of conductive and non-conductive metals, metal alloys, wood, wood-plastic composites, plastic-glass fiber reinforced composites, or any other suitable material utilized in the art. Moreover, it is contemplated that means for clamping 10, junction point 25 and ring assembly 20 can be comprised of the same material or comprised of different combinations of materials, depending on the desired configuration.

Although the means by which means for clamping 10 can clamp can be comprised of any one of many possible means known in the art, in the particular embodiment depicted in FIG. 3 means for clamping 10 utilizes upper arm 12 and lower arm 14. Upper arm 12 and lower arm 14 can be manipulated to lengthen or shorten space 13 disposed between upper arm 12 and lower arm 14. Laptop computer 2 is placed in space 13, with the end user manipulating upper arm 12 and lower arm 14 vertically along the y-axis, thereby decreasing or increasing the height of space 13 until upper arm 12 and lower arm 14 clamp onto a laptop computer 2. By manipulating upper arm 12 and lower arm 14 vertically up and down the y-axis, an end user can accommodate various laptop computer 2 widths and thereby enable upper arm 12 and lower arm 14 to clamp onto laptop computers of various thicknesses. It is contemplated that upper arm 12 and bottom arm 12 may be fitted (either individually or jointly) with various rib configurations, notches, grooves or other such features that enable upper arm 12 and lower arm 14 to grip onto a laptop at various points of contact. In the particular embodiment depicted in FIG. 3, upper arm 12 and lower arm 14 are equipped with cushion 16, which prevents either upper arm 12 and lower arm 14 from scratching the surface of laptop computer 2 or otherwise damaging laptop computer 2 when upper arm 12 and lower arm 14 clamp onto laptop computer 2. Cushion 16 has the additional benefit of creating a friction interface with laptop computer 2, which limits slippage of the laptop computer 2 once it is disposed between upper arm 12 and lower arm 14.

There are a variety of possible means by which an end user can manipulate upper arm 12 and lower arm 14 to clamp onto laptop computer 2. In the embodiment depicted in FIG. 3, for example, thumbscrew 30 serves as the means of raising and lowering lower arm 14 in reference to laptop computer 2, with upper arm 12 remaining in a stationary position relative to lower arm 14 as lower arm 14 traverses up and down the y-axis. A "thumbscrew" is defined herein as a specialized type of screw with a tall head and ridged or knurled sides, intended to be tightened and loosened by hand. Referring still to FIG. 3, an end user can either tighten or loosen thumbscrew 30 by rotating thumbscrew 30 to the left or the right. The tightening or loosening of thumbscrew 30 can be carried out via turn button 41. FIG. 3 depicts thumbscrew 30 disposed on the top of and through upper arm 12, extending down the y-axis and through an aperture bored through lower arm 14, with thumbscrew shaft 31 connected to locking lever 35 by a hinge pin 61. The net effect of tightening or loosening thumbscrew 30 via turn button 41 is to either increase or decrease the length of threaded thumbscrew shaft 31 in relation to lower arm 14. In this particular embodiment, spring 33 is disposed about thumbscrew shaft 31, with spring 33 exerting a downward force on lower arm 14. Turning thumbscrew 30 causes threaded thumbscrew shaft 31 to traverse up or down the vertical y-axis, thereby raising or lowering lower arm 14 vertically up and down the vertical y-axis in relation to the surface of laptop computer 2.

Figure 4:
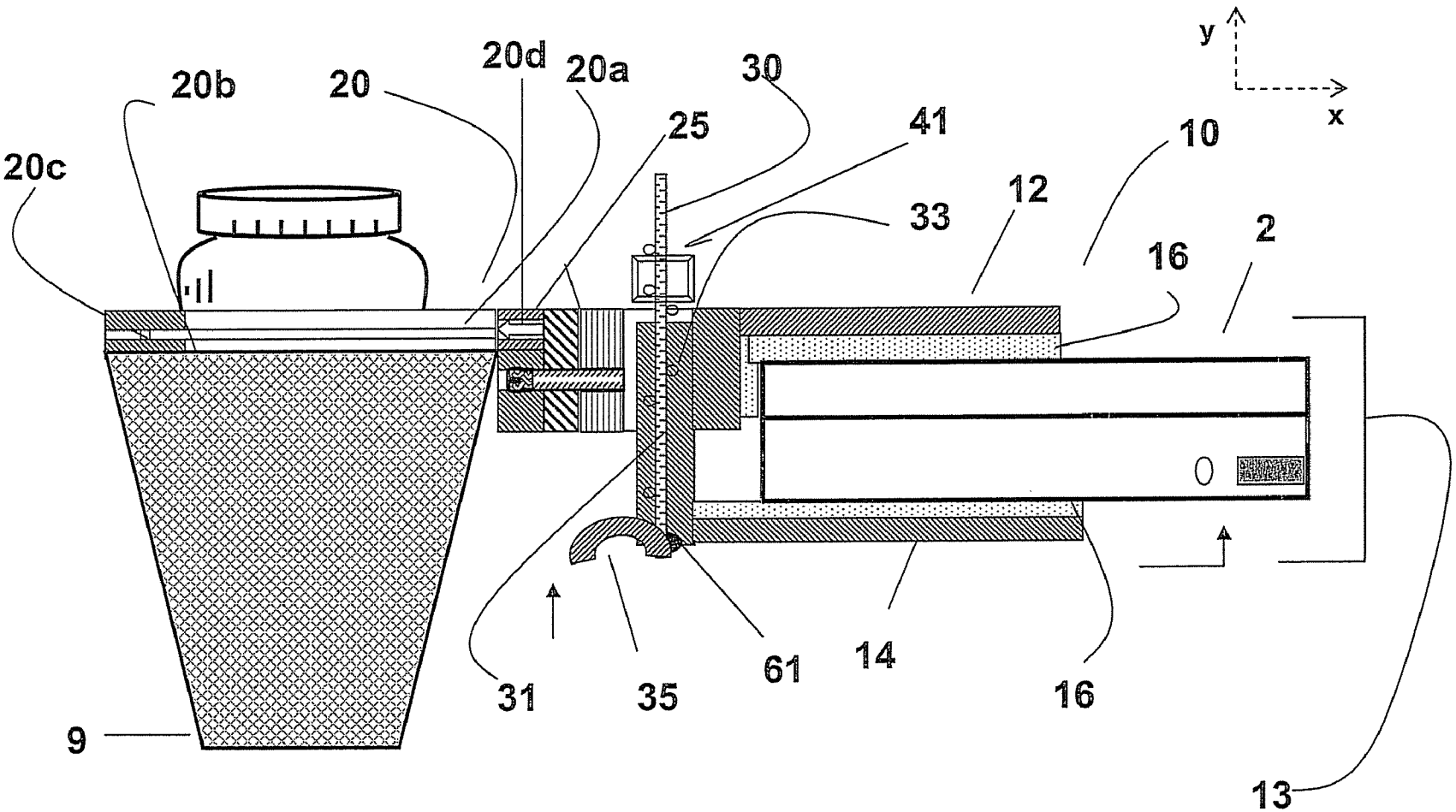
FIG. 4 is a side perspective view of the various components of an embodiment of the portable beverage container holder, with the lower arm in a locked position.

In the particular embodiment found in FIG. 3, beverage container holder 1 has an additional means of manipulating the length of space 13, as set forth in locking lever 35. Instead of solely utilizing thumbscrew 30 to adjust the amount of space 13 disposed between upper arm 12 and lower arm 14, an end user can utilize locking lever 35 to adjust the position of lower arm 14 along the y-axis. In FIG. 3, locking lever 35 is in the unlocked position, which creates a larger space 13 differential when compared to the amount of space 13 found in FIG. 4. FIG. 4 differs from FIG. 3 in that locking lever 35 in FIG. 4 is depicted in the locked position. By placing locking lever 35 in the locked position depicted in FIG. 4 or the unlocked position depicted in depicted in FIG. 3, the amount of space 13 between upper arm 12 and lower arm 14 can quickly be manipulated without having to manually turn thumbscrew 30. This allows an end user to quickly lock lower arm 14 onto laptop computer 2 or to add additional tightness when lower arm 14 comes into contact with laptop computer 2. When an end user shifts locking lever 35 to the locked position depicted in FIG. 4, spring 33 maintains compression tension between upper arm 12 and lower arm 14. The compression tension, in turn, allows the cam interface surface of locking lever 35 to maintain contact with the bottom surface of lower arm 14. Locking lever 35 is comprised of a cam surface configured so that when it is manipulated from left of the y-axis centerline of thumbscrew shaft 31, as depicted in FIG. 3, to the locked position, depicted in FIG. 4, lower arm 14 is raised a certain approximate distance between the centerline of the hinge pin 61, and contact surface of the locking lever 35. Still referring to FIG. 4, as the locking lever 35 moves past a certain point, locking lever 35 snaps into the locked position via the compression pressure of spring 33. The ongoing compression pressure of spring 33 enables locking lever 35 to remain in the "locked" position until the end user manipulates locking lever 35 to the unlocked position as shown in FIG. 3. Because locking lever 35 may be in close proximity to the end user, especially if laptop computer 2 is balanced on the end user's lap instead of a table or other such surface, locking lever 35 can be cushioned, disposed with a plastic coating, and/or ergonomically configured to protect an end user who may come in contact with locking lever 35.

It is noted that for all of the foregoing descriptions relating to the upper arm 12, lower arm 14, locking lever 35, turn button 41, and thumbscrew 30, the orientation and location of each component is immaterial. The presently contemplated invention envisions lower arm 14 remaining stationary, with upper arm 14 moving vertically up and down the y-axis, and envisions both upper arm 12 and lower arm 14 moving simultaneously to manipulate the length of space 13. In addition, although turn button 41 is located on the top of upper arm 12 in FIG. 3, turn button 41 can be positioned anywhere along beverage container holder 1.

Referring still to FIG. 3, we will now consider in greater detail ring assembly 20. It is contemplated that ring assembly 20 can be constructed in any matter so long as pocket 9 is attached. In the particular embodiment depicted in FIG. 3, ring assembly 20 is comprised of upper ring assembly 20*a* and lower ring assembly 20*b*, with upper ring assembly 20*a* and lower ring assembly 20*b* connected together via fix point 20*c*, with pocket 9 is sandwiched between the upper ring assembly 20*a* and lower ring assembly 20*b* at fix point 20*c*. Fix point 20*c* connects upper ring assembly 20*a* and lower ring assembly 20 via any applicable means useful in the art, including, without limitation: adhesives and mechanical means. In FIG. 3, pocket 9 is held in place between upper ring assembly 20*a* and lower ring assembly 20*b*, with fix point 20*c* connecting upper ring assembly 20*a* and lower ring assembly 20*b* by means of a mechanical threaded screw.

It is contemplated that pocket 9 can be removed from ring assembly 20 by disconnecting fix point 20*c* so as to enable an end user to clean pocket 9 or to insert a different type of pocket 9 to be used in conjunction with ring assembly 20. In addition, ring assembly 20 can be constructed in such a way that pocket 9 is permanently connected to ring assembly 20 and is not removable. In considering the shape of ring assembly 20, the particular shape is immaterial as the presently contemplated ring assembly 20 can have any given shape. In the given embodiment depicted in FIG. 3, for example, ring assembly 20 has a circular shape. Moreover, ring assembly 20 can come in many different dimensions and can have many different diameters, as applicable. For a ring assembly 20 with a circular shape (like the ring assembly depicted in FIG. 3) it is contemplated that ring assembly 20 can have a diameter than can manually be increased or decreased by the end user in order to tighten or loosen the ring assembly 20 around whatever object that is placed in pocket 9.

Figure 5:
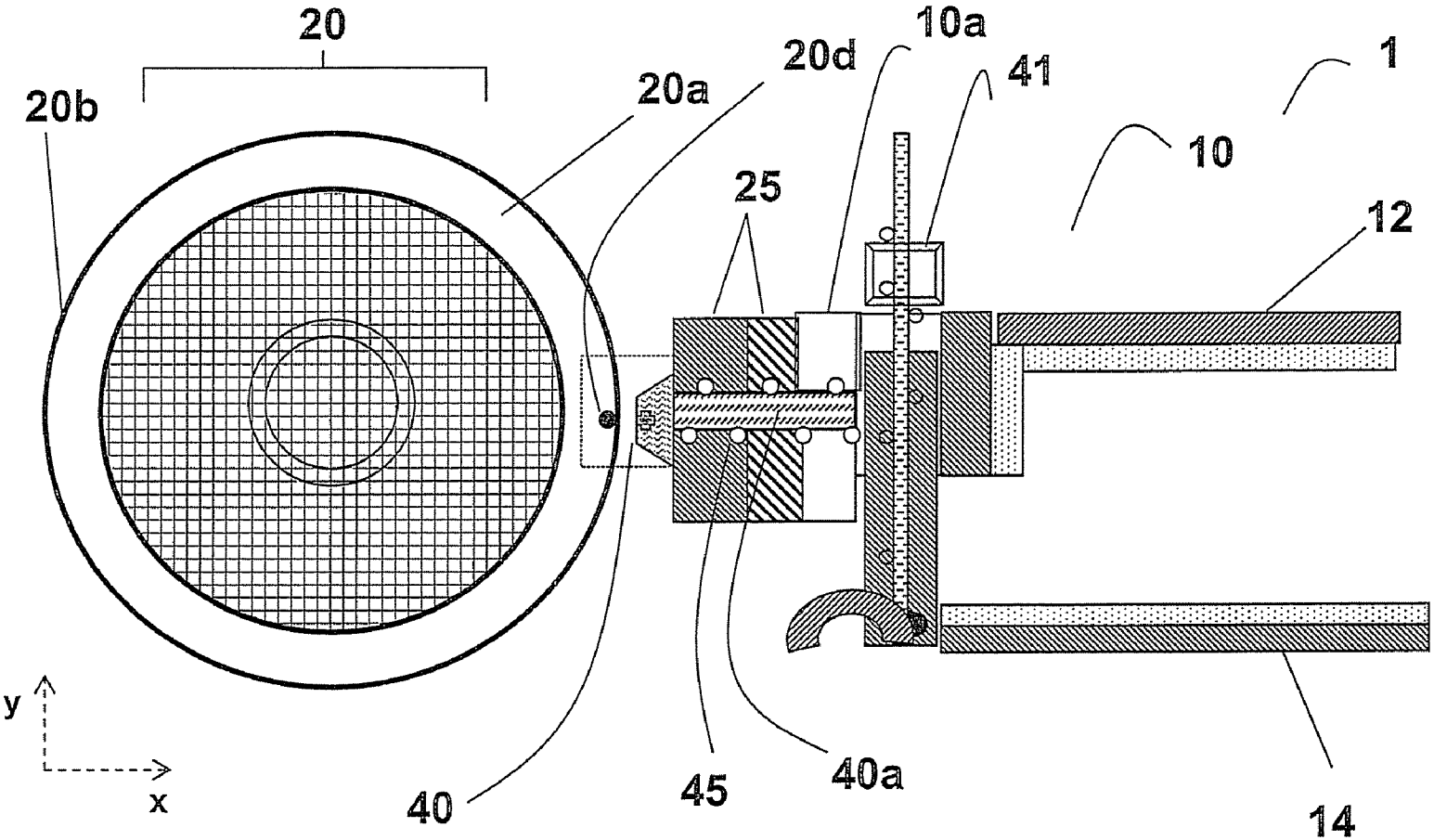
FIG. 5 is a side perspective view of portable beverage container holder, with the portable beverage container holder set in the travel position.

Referring now to FIG. 5, another advantage of the presently contemplated invention is depicted, specifically related to the means for transporting beverage container holder 1. To enable an end user to transport beverage container holder 1 without taking up too much space in luggage or in other traveling accoutrements, the presently claimed invention includes a feature that renders beverage container holder 1 more compact and flat. In the embodiment illustrated in FIG. 5, the means for transport involve ring assembly 20 being rotated approximately ninety (90) degrees around the x-axis until both upper ring assembly 20*a* and lower ring assembly 20*b* are perpendicular to the x-axis, thereby rendering beverage container holder 1 flat. Rotating ring assembly 20 around the x-axis can be accomplished in any one of many possible means, but in the embodiment depicted in FIG. 5, junction point 25 (to which ring assembly 20 is connected) is connected to means for clamping junction point 10*a* via transverse screw 40. Transverse screw 40 utilizes a traverse spring 45 coiled around traverse screw shaft 40*a* to keep junction point 25 adjacent to and flush with means for clamping junction point 10*a* via the spring constant pulling towards means for clamping junction point 10*a*. In FIG. 5, for example, traverse spring 45 is completely compressed up against traverse screw 40. Traverse screw 40 is disposed in such a manner, however, that junction point 25 can be pulled by the end user away from means for clamping junction point 10*a*, in a direction opposite from the spring constant and away from means for clamping junction point 10*a*, thereby enabling the end user enough separation from means for clamping junction point 10*a* to rotate ring assembly 20 around the x-axis. Moreover, the upper arm assembly 12 can be notched so after the ring assembly 20 has been rotated into position, ring assembly 20 is retained within the notched area, which prevents unwanted movement during storage. This enables an end user to easily store beverage container holder 1 in a suitcase, briefcase, or even in the end user's pocket.

Figure 6:
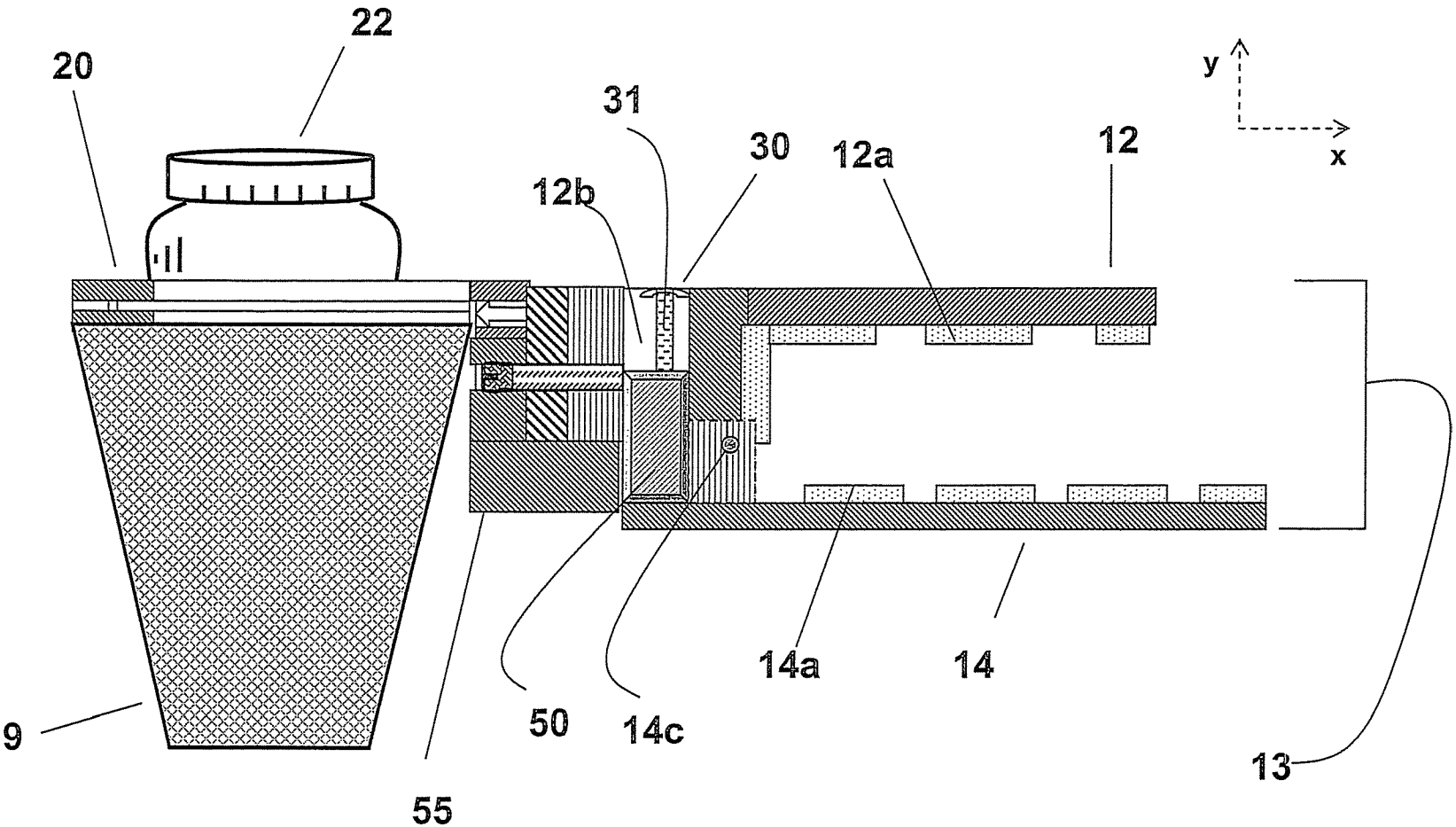
FIG. 6 is a side perspective view of the various components of an alternate embodiment of the portable beverage container holder.
Figure 7:
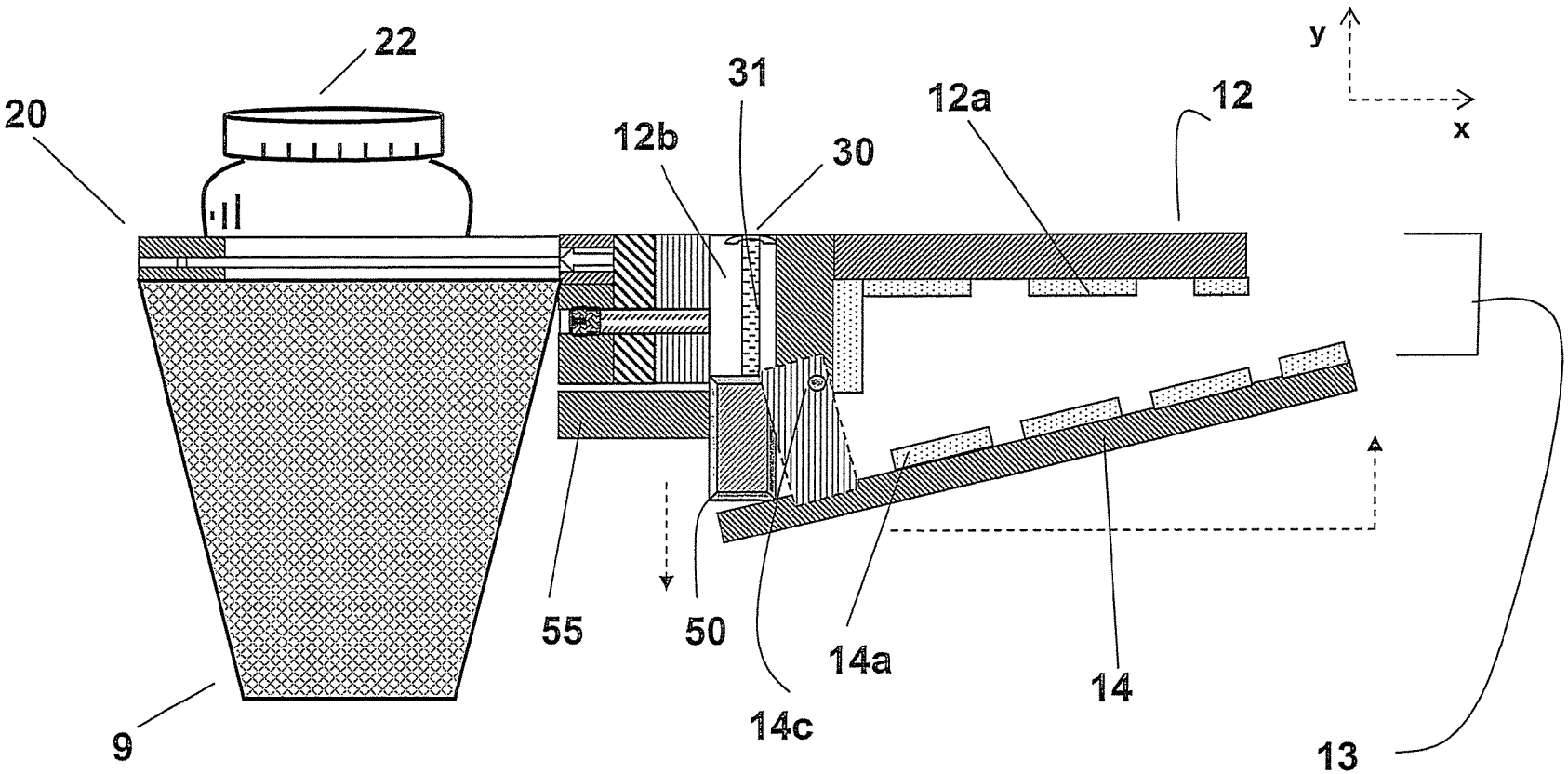
FIG. 7 is a side perspective view of the various components of an alternate embodiment of the portable beverage container holder, in the closed position.

Now that a thorough explanation of the given components of a particular embodiment has been completed, the inventors will now describe in detail some additional possible embodiments. Referring now to FIG. 6, depicted is an alternative means for clamping 10 and manipulating the amount of space 13 between upper arm 12 and lower arm 14. In this embodiment, lower arm 14 is connected to upper arm 12 via swing point 14*c*, which allows lower arm 14 to become displaced in an approximate range of zero degrees to forty-five degrees from the x-axis, thereby manipulating the length of space 13. Moreover, in the particular embodiment set forth in FIG. 6, thumbscrew 30 and thumbscrew shaft 31 are embedded within upper arm cavity 12*b*. Unlike previously described embodiments, an end user does not have access to thumbscrew 30 via the top of upper arm 12. Instead, thumbscrew 30 and thumbscrew shaft 31 are fixed and in a stationary position. Thumbscrew shaft 31 is embedded in a threaded aperture disposed through link 50, and can be screwed and unscrewed from the threaded aperture disposed through link 50. By tightening or loosening link 50, the length of threaded thumbscrew shaft 31 in relation to lower arm 14 is either increased or decreased. By increasing or decreasing the length of thumbscrew shaft 31 in relation to lower arm 14, link 50 exerts a certain amount of downward force on lower arm 14, and causes lower arm 14 to pivot about swing point 14*c*. FIG. 6 depicts lower arm 14 in a stationary position, with link 50 not protruding past bottom cusp 55. FIG. 7, on the other hand, depicts lower arm 14 in a closed position, wherein lower arm 14 is displaced via from the x-axis in an approximate range of zero degrees to forty-five degrees swing point 14*c*, thereby decreasing the amount of space 13. In FIG. 7, link 50 protrudes past bottom cusp 55, which is caused by the end user turning and manipulating link 50 about thumbscrew shaft 31 until link 50 travels vertically down the y axis and past bottom cusp 55, which subsequently causes a downward force on lower arm 14 and displaces lower arm 14 from the x-axis via swing point 14*c* and decreasing the length of space 13. It is contemplated that the means described via FIG. 6 and FIG. 7 can be accomplished in the reverse, i.e, manipulating upper arm 12 (as opposed to just lower arm 14) or by manipulating both upper arm 12 and lower arm 14. It is noted that in FIG. 5 and FIG. 6, upper arm 12 and lower arm 14 are disposed with notches 12*a* and 14*a*. Notches 12*a* and 14*a* are an additional means of improving the grip upper arm 12 and lower arm 14 can exert on laptop 2 set in space 13.

Figure 8:
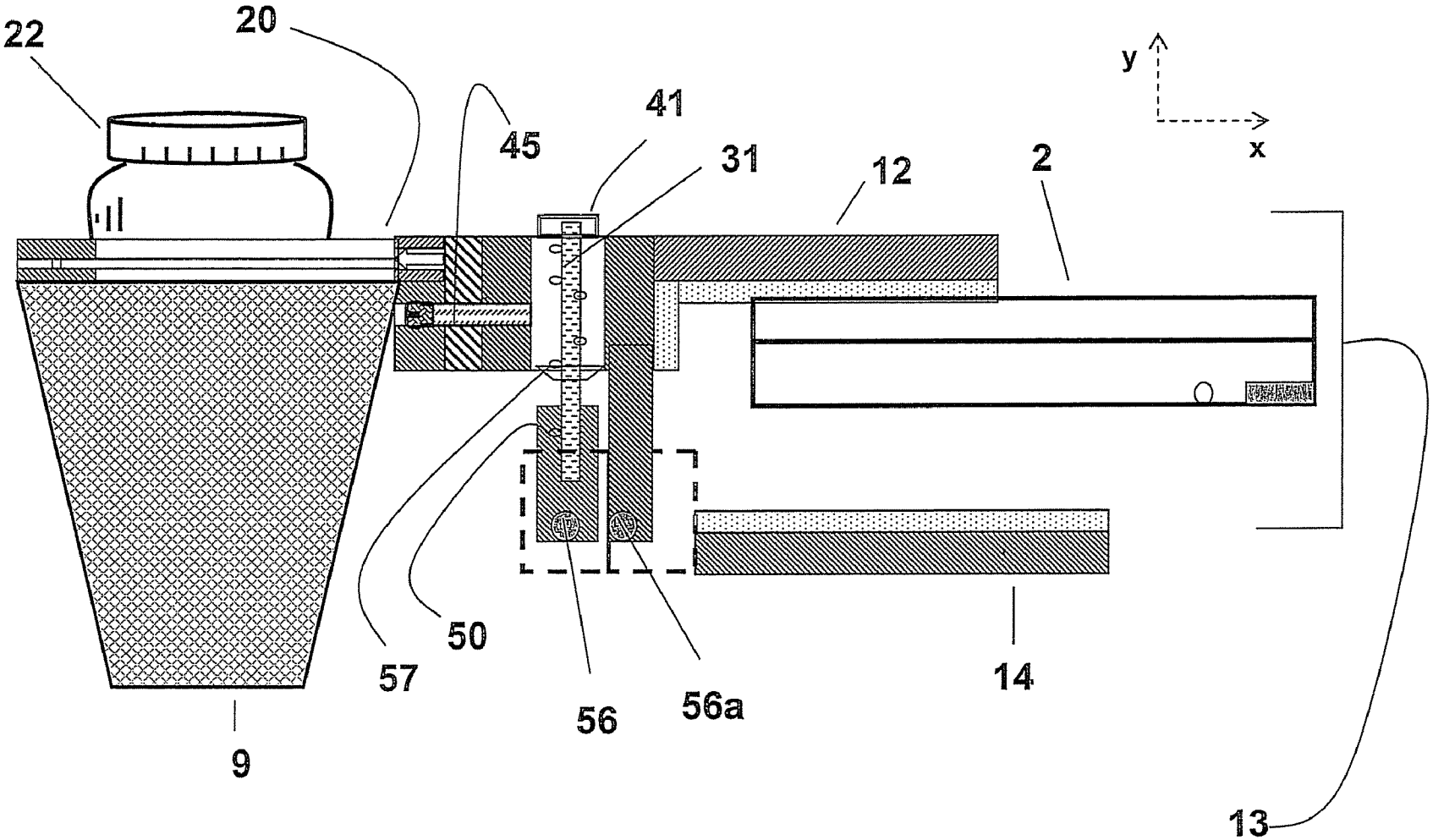
FIG. 8 is a side perspective view of the various components of an alternate embodiment of the portable beverage container holder.
Figure 9:
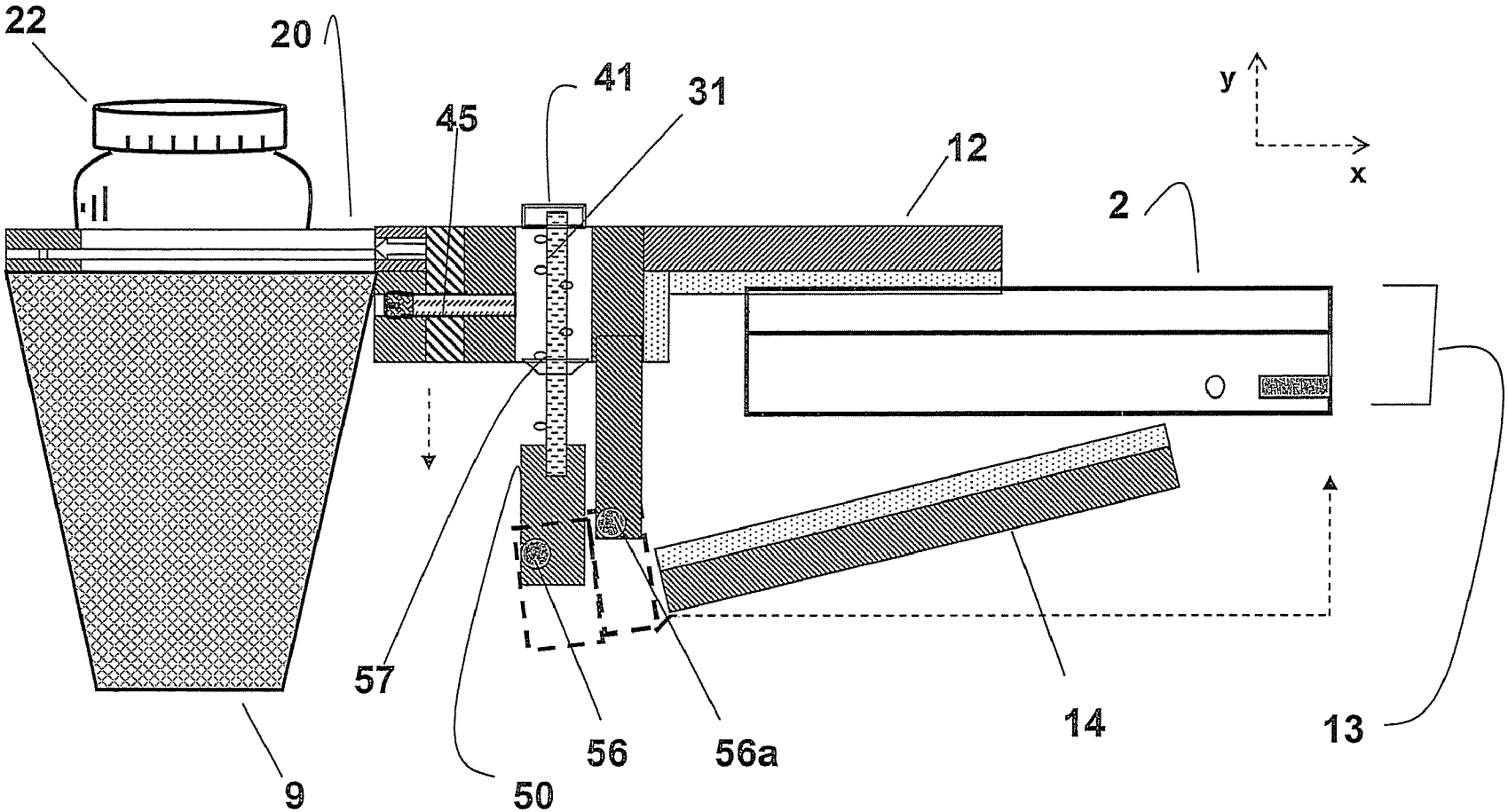
FIG. 9 is a side perspective view of the various components of an alternate embodiment of the portable beverage container holder, in the closed position.

Considering yet another possible embodiment of the presently contemplated invention, we will focus now on FIG. 8 and FIG. 9. Referring to FIG. 8, depicted is yet another possible means for clamping 10 and manipulating the amount of space 13 between upper arm 12 and lower arm 14. In this particular embodiment, the upper portion of thumbscrew shaft 31 is embedded in turn button 41, with the lower portion of thumbscrew shaft 31 embedded in link 50. Link 50 is disposed with a threaded aperture, into which thumbscrew shaft 31 can be screwed or unscrewed, and link 50 is connected to lower arm 14 via pivot pin 56. As set forth in FIG. 8, lower arm 14 is connected to upper arm 12, via pivot pin 56*a* As turn button 41 is rotated counterclockwise, thumbscrew shaft 31 moves out of the threaded aperture of pivot cap 50, causing pivot cap 50 to exert a downward force on lower arm 14 and thereby creating a pivoting action around pivot pin 56. The downward force exerted on lower arm 14 and the ensuing pivot action around pivot pin 56 causes lower arm 14 to pivot around pin 56*a* from approximately zero degrees to forty-five degrees, thereby raising lower arm 14 and decreasing space 13 and clamping lower arm 14 to laptop computer 2. FIG. 7. depicts lower arm 14 in an open position, with link 50 and pivot pin 56*a* parallel and resting on the x-axis. FIG. 9, on the other hand, depicts lower arm 14 in a closed position, caused by the user rotating turn button 41 counterclockwise, exerting a downward force on lower arm 14 via pivot cap 50 and pushing lower arm 14 around pivot pin 56 below the x-axis of pivot pin 56*a*. It is contemplated that the means described via FIG. 8 and FIG. 9 can be accomplished in the reverse, i.e, manipulating turn button 41 clockwise. By manipulating turn button 41 clockwise, it is thumbscrew shaft 31 becomes more deeply engaged into pivot cap 50, thereby pulling pivot cap 50 upwards and resulting in a rotation around pivot pin 56 and pivot pin 56*a* that lowers lower arm 14. In the particular embodiment depicted in FIG. 8 and FIG. 9, a shaft retention washer 57 threaded on thumbscrew shaft 31 and disposed on the underside of upper arm 12 prevents thumbscrew screw 30 from vertical movement and keeps turn button 41 in contact with the top surface of upper arm 12.

Figure 10:
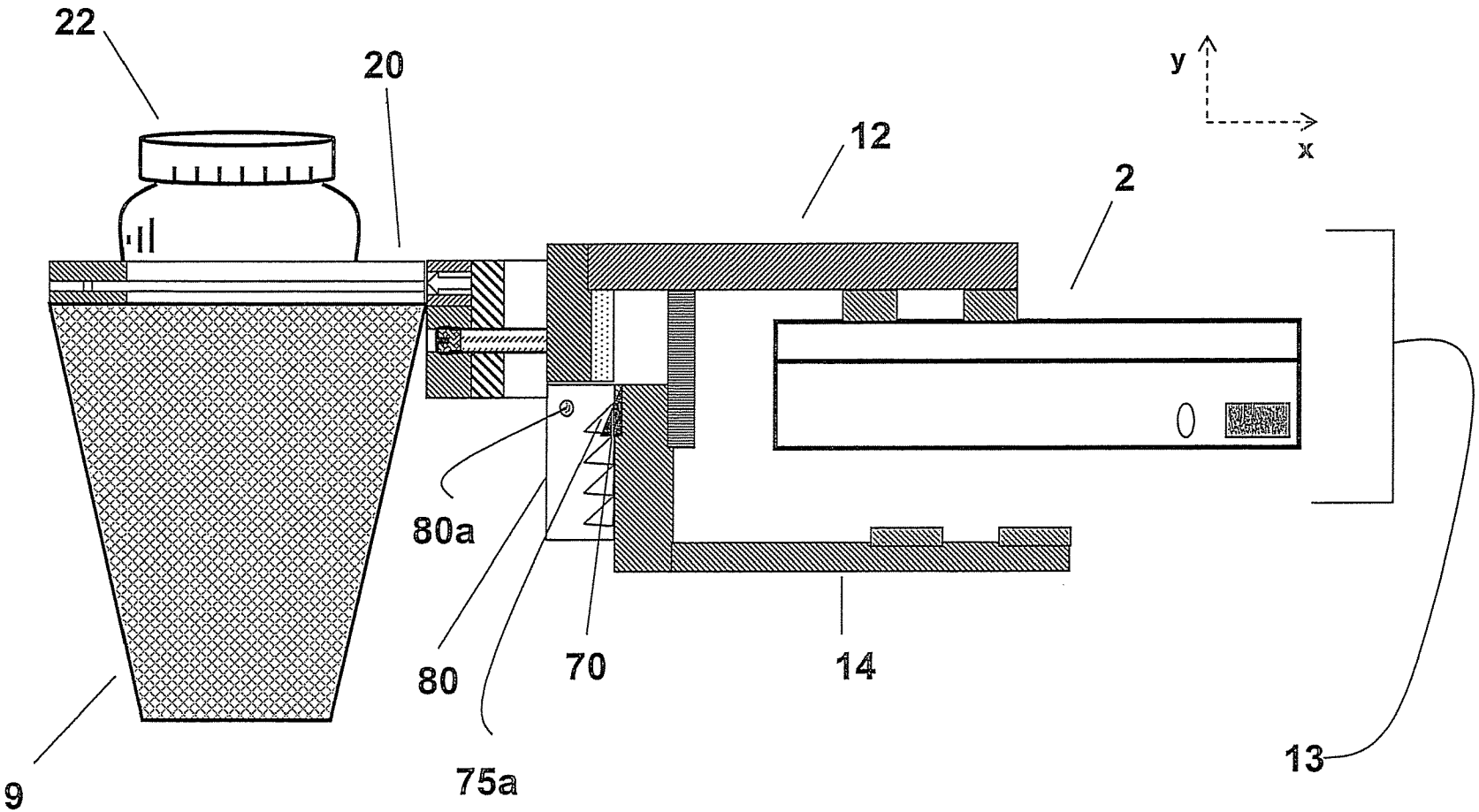
FIG. 10 is a side perspective view of the various components of an alternate embodiment of the portable beverage container holder, in the closed position.
Figure 11:
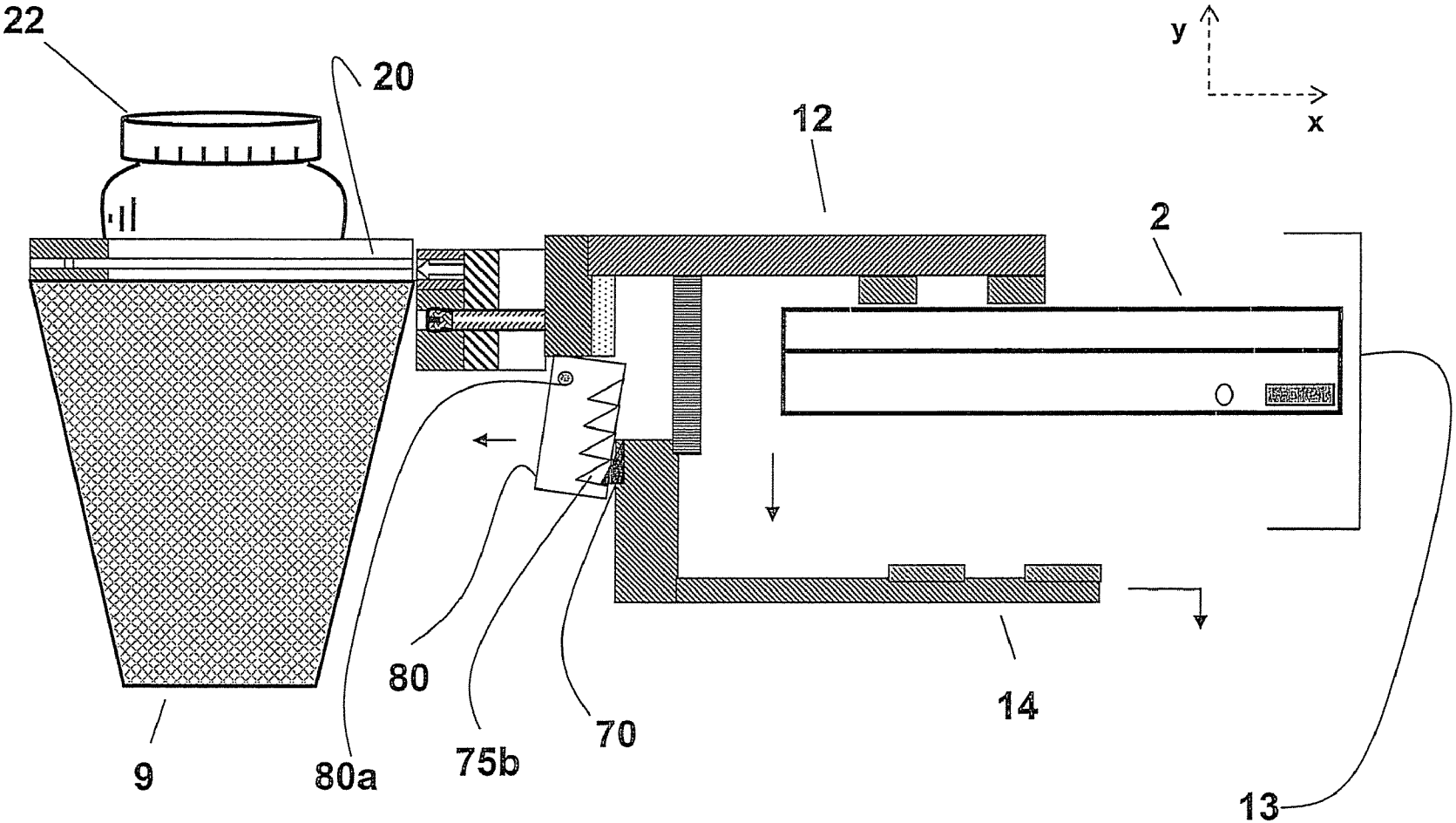
FIG. 11 is a side perspective view of the various components of an alternate embodiment of the portable beverage container holder, in the open position.

Considering an additional embodiment of the presently claimed invention, we focus now on FIG. 10 and FIG. 1. Referring to FIG. 10, depicted is an alternative means for clamping 10 and manipulating the space 13 between upper arm 12 and lower arm 14. In FIG. 10, lower arm 14 is equipped with protruding tooth 70. Although there is only one protruding tooth 70 depicted in FIG. 10, the presently claimed invention contemplates the use of a plurality of protruding teeth and envisions the use of protruding teeth disposed on an alternate side or sides of lower arm 14, instead of just one side as is presently depicted. In this particular embodiment, protruding tooth 70 is adapted to fit protruding tooth notch 75*a*, which is disposed about the lower portion of upper arm 12. Because protruding tooth 70 fits in protruding tooth notch 75*a*, lower arm 14 is locked in place and is not able to move vertically down the y-axis, thereby fixing space 13 at a given distance. Referring to FIG. 11, it is noted that protruding tooth 70 has been displaced down the vertical y-axis to protruding tooth notch 75*b*, which lies beneath protruding tooth notch 75*a* on the vertical y-axis. By moving protruding tooth 70 from protruding tooth notch 75*a* to protruding tooth notch 75*b*, lower arm 14 is displaced down the vertical y-axis, thereby increasing the distance between upper arm 12 and lower arm 14 and increasing the distance of space 13. In traversing down the y-axis, lower arm 14 is kept in place via block notch 80. Block notch 80 is hinged with a pin forming a pivot point at block notch pivot 80*a*. A torsion spring, at the block notch pivot 80*a*, maintains pressure on block notch 80 keeping protruding tooth 70 in the desired protruding tooth notch. Lower arm 14 can be moved up into the cavity of lower arm 12 by simple hand pressure, which overcomes the torsion spring force permitting protruding tooth 70 to move up and down the vertical y-axis and reducing or increasing space 13 until maximum clamping force against the laptop computer 2 is reached.

Figure 12:
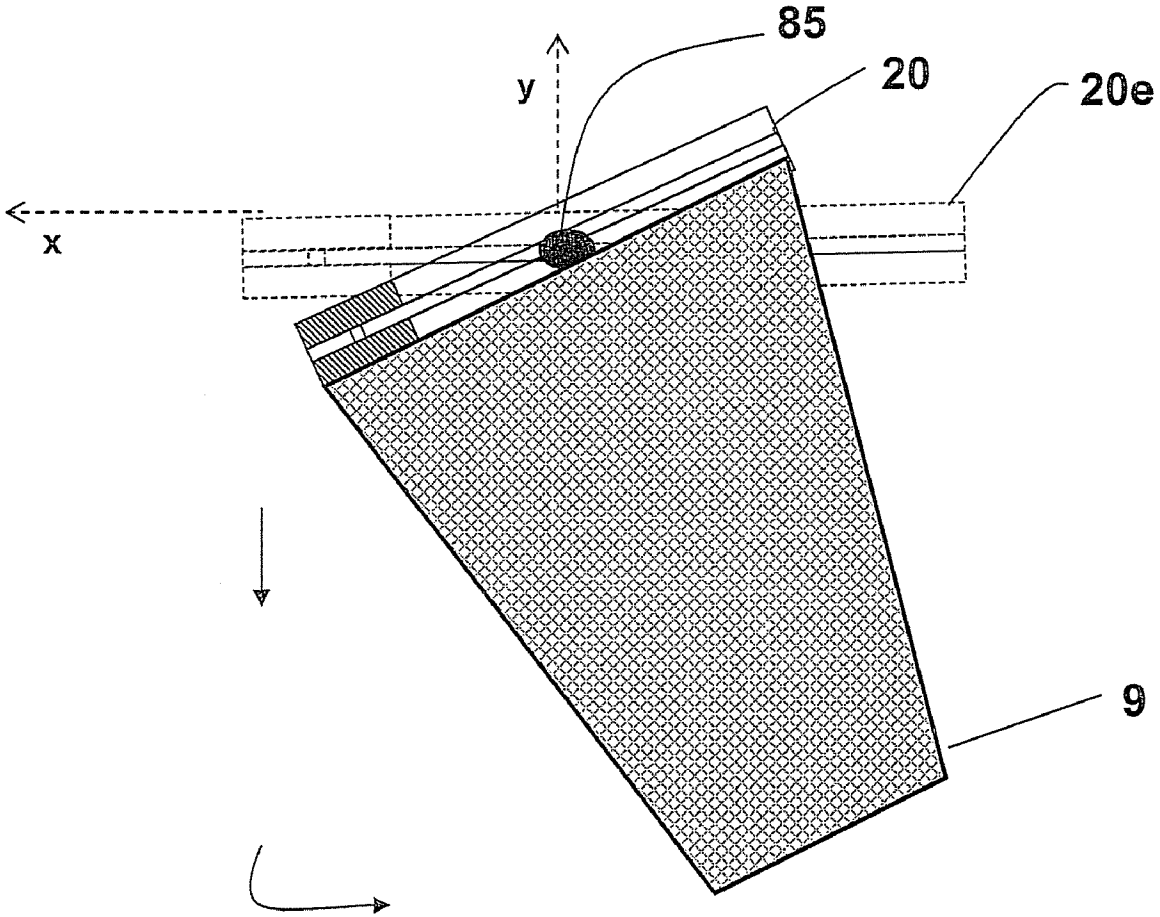
FIG. 12 is a front perspective view of ring assembly and pocket, illustrating the leveling ability of the portable beverage container holder.

Focusing now on the last figure, FIG. 12, depicted is a front perspective view of pocket 9 and ring assembly 20. This embodiment illustrates another contemplated feature of the invention, i.e. the ability to pivot ring assembly 20 about the x-axis and y-axis via assembly ring pivot point 85. The ability to pivot ring assembly 20 about the x-axis and y-axis via assembly ring pivot point 85 allows an end user to self level the ring assembly 20 to ensure any inserted items do not spill and or fall from pocket 9 during adverse travel conditions. In the embodiment depicted in FIG. 12, the original position of ring assembly 20 is set forth via position 20*e*, which is completely parallel to the x-axis. After an end user pivots ring assembly 20 via assembly ring pivot point 85, there is a displacement from the x-axis, as depicted in FIG. 12. Ring assembly can be rotated in any direction about the x-axis, depending on the end user's inclinations and needs. It is contemplated that leveling can occur via end user manipulation or automatically via counter weights or other means of automatic leveling known in the art.

It is to be understood that the present invention is by no means limited only to the particular constructions herein disclosed and shown in the drawings, but also comprises any modifications or equivalents within the scope of the claims.

We claim:

1. A portable container for holding items, comprising:

a pocket adapted to hold and receive items, the pocket having at least one aperture disposed about a length of the pocket and the aperture providing access to an inner compartment of the pocket;

at least one ring assembly, with the ring assembly further comprising: at least one upper ring assembly having a substantially rigid frame; and at least one lower ring assembly having a substantially rigid frame;

a means for connecting the ring assembly to the pocket; and a means for clamping comprising an upper arm and a lower arm that can be manipulated to change a space disposed between the upper arm and the lower arm, wherein the ring assembly is connected to the means for clamping via a pivot junction point for allowing the ring assembly to pivot wherein a plane of the ring assembly has a first position which is generally parallel to the plane of the upper and lower arms and a second position in which the plane of the ring assembly is disposed generally perpendicular to the plane of the first and second arms.

2. The portable container of claim 1, wherein the upper arm clamps from above onto a substantially planar surface and the lower arm clamps from below onto the substantially planar surface.

3. The portable container of claim 2, wherein the lower arm is locked into place below the substantially planar surface via a means for locking.

4. The portable container of claim 2, wherein the upper arm is locked into place above the substantially planar surface via a means for locking.

5. The portable container of claim 2, wherein the upper arm is disposed with a protective cushion capable of engaging the substantially planar surface from above.

6. The portable container of claim 2, wherein the lower arm is disposed with a protective cushion capable of engaging the substantially planar surface from below.

7. The portable container of claim 2, wherein the upper arm and the lower arm are both disposed with protective cushions capable of engaging the substantially planar surface.

8. The portable container of claim 1, wherein a diameter of the ring assembly can be manually increased and decreased.

9. The portable container of claim 1, wherein the pocket can be removed from the ring assembly and replaced with an alternate pocket.

10. The portable container of claim 1, wherein the pocket is lined with an insulating material.

11. The portable container of claim 1, wherein the ring assembly is self leveling.

12. A portable beverage container holder for a laptop computer, the portable beverage container holder comprising:

a pocket adapted to hold and receive a beverage container, the pocket having at least one aperture disposed about a length of the pocket and the aperture providing access to an inner compartment of the pocket;

at least one ring assembly, with the ring assembly further comprising: at least one upper ring assembly having a substantially rigid cylindrical frame; and at least one lower ring assembly having a substantially rigid cylindrical frame, with the lower ring assembly parallel to and connected to the upper ring assembly;

a means for connecting the pocket to the ring assembly, wherein the means for connecting the pocket to the ring assembly comprises fastening the pocket between the upper ring assembly and the lower ring assembly and connecting the upper ring assembly to the lower ring assembly with the pocket disposed between the upper ring assembly and the lower ring assembly; and a means for clamping to a laptop computer comprising an upper arm and a lower arm that can be manipulated to change a space disposed between the upper arm and the lower arm, wherein the ring assembly is connected to the means for clamping via a pivot junction point for allowing the ring assembly to pivot wherein a plane of the ring assembly has a first position which is generally parallel to the plane of the upper and lower arms and a second position in which the plane of the ring assembly is disposed generally perpendicular to the plane of the first and second arms.

13. The portable beverage container holder of claim 12, wherein the upper arm clamps from above onto the laptop computer and the lower arm clamps from below onto the laptop computer.

14. The portable beverage container holder of claim 13, wherein the lower arm is locked into place below the laptop computer via a means for locking.

15. The portable beverage container holder of claim 13, wherein the upper arm is locked into place above the laptop computer via a means for locking.

16. The portable beverage container holder of claim 13, wherein the upper arm is disposed with a protective cushion capable of engaging the laptop computer from above.

17. The portable beverage container holder of claim 13, wherein the lower arm is disposed with a protective cushion capable of engaging the laptop computer from below.

18. The portable beverage container holder of claim 13, wherein the upper arm and the lower arm are both disposed with protective cushions capable of engaging the laptop computer.

19. The portable beverage container holder of claim 12, wherein a diameter of the ring assembly can be manually increased and decreased.

20. The portable beverage container holder of claim 12, wherein the pocket can be removed from the ring assembly and replaced with an alternate pocket.

21. The portable beverage container holder of claim 12, wherein the pocket is lined with an insulating material.

22. The portable beverage container holder of claim 12, wherein the ring assembly is self leveling.

23. A portable beverage container holder for use during travel, comprising:

a pocket adapted to hold and receive a beverage container, the pocket having at least one aperture disposed about a length of the pocket and the aperture providing access to an inner compartment of the pocket; at least one ring assembly, with the ring assembly further comprising: at least one upper ring assembly; and at least one lower ring assembly, with the lower ring assembly parallel to and connected to the upper ring assembly;

a means for connecting the pocket to the ring assembly, wherein the means for connecting the pocket to the ring assembly comprises fastening the pocket between the upper ring assembly and the lower ring assembly and connecting the upper ring assembly to the lower ring assembly with the pocket disposed between the upper ring assembly and the lower ring assembly;

a means for clamping to a substantially planar surface comprising an upper arm and a lower arm that can be manipulated to change a space disposed between the upper arm and the lower arm, wherein the ring assembly is connected to the means for clamping via a junction point; and a means for transporting the beverage container holder comprising a pivot means within the junction point for allowing the ring assembly to pivot wherein a plane of the ring assembly has a first position which is generally parallel to the plane of the upper and lower arms and a second position in which the plane of the ring assembly is disposed generally perpendicular to the plane of the first and second arms, wherein the portable beverage holder is collapsible by rotating the ring assembly until the ring assembly is flat with the upper and lower arms.

24. The portable beverage container holder of claim 23, wherein the upper arm clamps from above onto the substantially planar surface and the lower arm clamps from below onto the substantially planar surface.

25. The portable beverage container holder of claim 24, wherein the lower arm is locked into place below the substantially planar surface via a means for locking.

26. The portable beverage container holder of claim 24, wherein the upper arm is locked into place above the substantially planar surface via a means for locking.

27. The portable beverage container holder of claim 23, wherein the upper arm is disposed with a protective cushion capable of engaging the substantially planar surface from above.

28. The portable beverage container holder of claim 23, wherein the lower arm is disposed with a protective cushion capable of engaging the substantially planar surface from below.

29. The portable beverage container holder of claim 23, wherein the upper arm and the lower arm are both disposed with protective cushions capable of engaging the substantially planar surface.

30. The portable beverage container holder of claim 23, wherein a diameter of the ring assembly can be manually increased and decreased.

31. The portable beverage container holder of claim 23, wherein the pocket can be removed from the ring assembly and replaced with an alternate pocket.

32. The portable beverage container holder of claim 23, wherein the pocket is lined with an insulating material.

33. The portable beverage container holder of claim 23, wherein the ring assembly is self leveling.

* * * * *